US006868834B1

(12) United States Patent
Mitani et al.

(10) Patent No.: US 6,868,834 B1
(45) Date of Patent: Mar. 22, 2005

(54) FUEL SUPPLY SYSTEM

(75) Inventors: Tateki Mitani, Tokyo (JP); Minoru Takata, Tokyo (JP); Yusaku Sakai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/938,564

(22) Filed: Sep. 13, 2004

(30) Foreign Application Priority Data

Mar. 29, 2004 (JP) ..... P2004-094723
Jun. 8, 2004 (JP) ..... P2004-170187

(51) Int. Cl.[7] ..... F02M 37/04
(52) U.S. Cl. ..... 123/495; 123/497; 123/509
(58) Field of Search ..... 123/495, 497, 123/498, 499, 509; 210/348

(56) References Cited

U.S. PATENT DOCUMENTS 5,452,701 A * 9/1995 Tuckey ..... 123/509
6,109,893 A * 8/2000 Gliniecki et al. ..... 417/423.7
6,231,318 B1 * 5/2001 Cotton et al. ..... 417/423.1

FOREIGN PATENT DOCUMENTS

JP 8-284769 A 10/1996
JP 2004-11550 A 1/2004

* cited by examiner

*Primary Examiner*—Bibhu Mohanty
(74) *Attorney, Agent, or Firm*—Sughrue Mion, PLLC

(57) ABSTRACT

A fuel supply system includes a bracket fitted around an opening portion of a fuel tank and having a discharge pipe disposed, and a fuel pump for sucking a fuel from the fuel tank and discharging the fuel through the discharge pipe, the fuel pump being mounted on the bracket. The fuel pump includes a pump portion for sucking and discharging the fuel from the fuel tank, a motor portion for rotating a rotor accommodated within the pump portion, through which the fuel discharged from the pump portion is passed internally, a cover out portion for accommodating a discharge filter for filtering the fuel passed through the motor portion, and a debris storage case for storing the debris in the fuel that is captured by the discharge filter, the case being disposed near the discharge filter.

8 Claims, 5 Drawing Sheets

FUEL SUPPLY SYSTEM

BACKGROUND OF THE INVENTION

1. Field of the Invention

The present invention relates to a fuel supply system for feeding under pressure a fuel within a fuel tank into an injector for an internal combustion engine for vehicle, and more particularly to a fuel supply system that is operated by a driving force of a DC motor.

2. Description of the Related Art

The conventional fuel supply system comprises a fuel pump portion for sucking and discharging fuel within the fuel tank, a motor portion for driving the fuel pump portion, and a barrel-like fuel filter for accommodating a filter medium filtering the fuel containing an abrasion powder produced when the motor portion is driven in the fuel.

In the above fuel supply system, when a power source is turned on, a rotor of the motor portion is rotated, and a pump mechanism is activated to suck a fuel within the fuel tank into the fuel pump portion, the sucked fuel entering a casing for the fuel filter. Within the casing, the fuel is passed through the filter medium to remove the dirt containing abrasion powder produced by the brush or commutator in the motor portion.

Thereafter, the fuel is passed through the fuel filter, and then fed under pressure through a discharge opening via a pipeline into the injector for the internal combustion engine for vehicle (e.g., refer to JP-A-8-284769).

The conventional fuel supply system as constituted above had a drawback that because it has a structure in which the fuel discharged from the fuel pump portion is passed through the motor portion to the fuel filter portion, the debris contained in the fuel, for example, abrasion powder from the brush or commutator forming the motor portion is once expelled from the motor portion, and then flowed back to the motor portion to deposit on or stick to a driving portion of the motor portion, thereby degrading the function of the fuel supply system.

SUMMARY OF THE INVENTION

This invention has been achieved to solve the above-mentioned problem, and it is an object of the invention to provide a fuel supply system with high reliability in which the debris produced in the motor portion does not stick to the driving portion of the motor portion.

This invention provides a fuel supply system comprising a bracket fitted around an opening portion of a fuel tank and having a discharge pipe disposed, and a fuel pump for sucking a fuel from the fuel tank and discharging the fuel through the discharge pipe, the fuel pump being mounted on the bracket, characterized in that the fuel pump comprises a pump portion for sucking and discharging the fuel from the fuel tank, a motor portion for rotating a rotor accommodated within the pump portion, through which the fuel discharged from the pump portion is passed internally, a cover out portion for accommodating a discharge filter for filtering the fuel passed through the motor portion, and a debris storage case for storing the debris in the fuel that is captured by the discharge filter, the case being disposed near the discharge filter.

With this invention, since the debris storage case for storing the debris in the fuel captured by the discharge filter is disposed near the discharge filter, the debris having a larger filtering particle diameter captured by the discharge filter among the debris produced by the motor portion is stored in the debris storage case without debris depositing on the motor portion or sticking to the motor driving portion, thereby making the fuel supply system highly reliable.

Also, since the fuel passage hole for passing the fuel flowing from the motor portion into the cover out portion is disposed at a circumferential position of the spacer around an outer diameter of the rotor in the motor portion, the debris produced in the motor portion, which is once expelled with the fuel from the motor portion, and then flowed back to the motor portion, does not stick to the motor driving portion, thereby making the fuel supply system highly reliable.

DETAILED DESCRIPTION OF THE PREFERRED EMBODIMENTS

Now, a description will be given in more detail of preferred embodiments of the invention with reference to the accompanying drawings.

(Embodiment 1)

Figure 1:
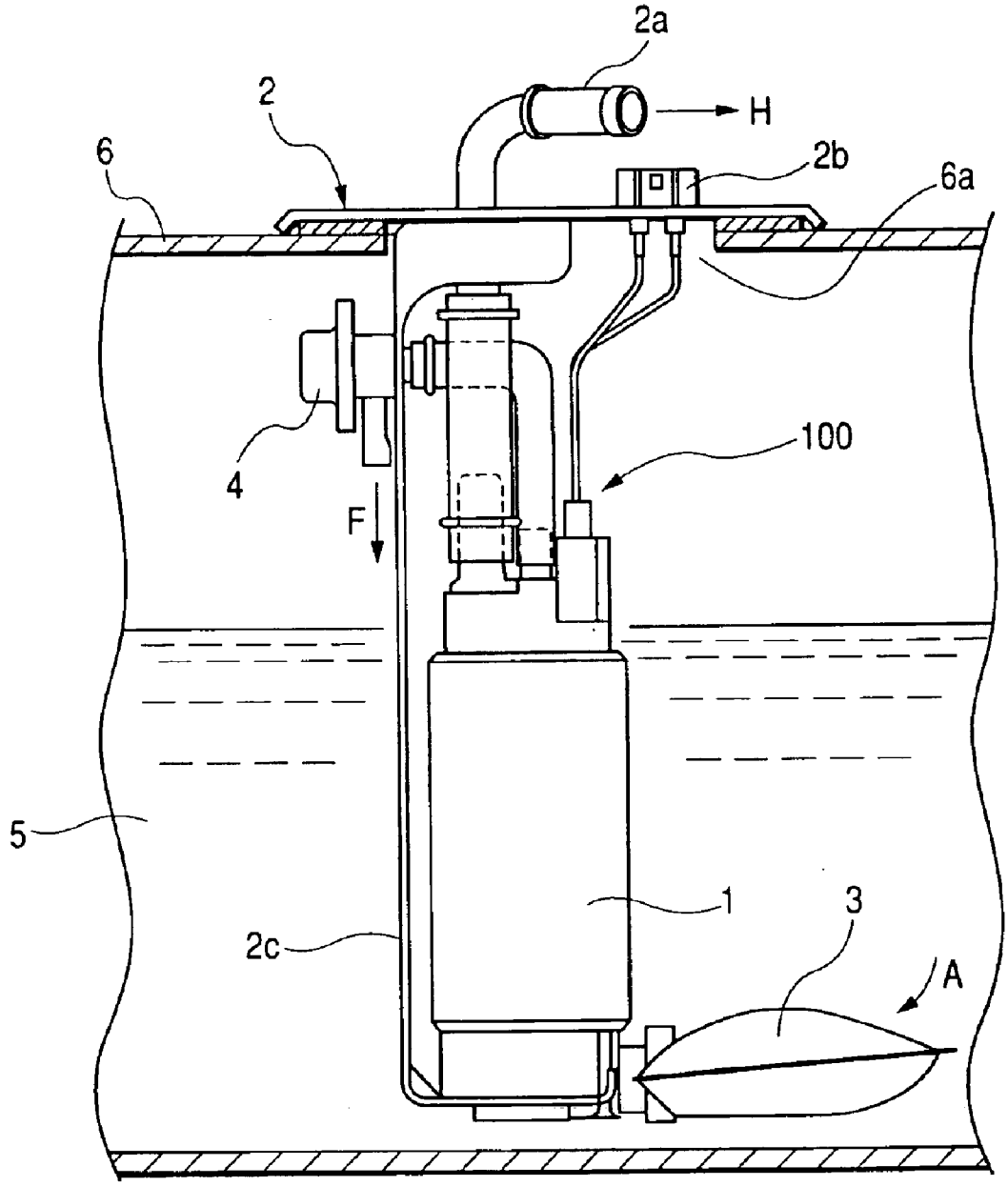
FIG. 1 is a view showing a fuel supply system according to an embodiment 1 of the invention.
Figure 2:
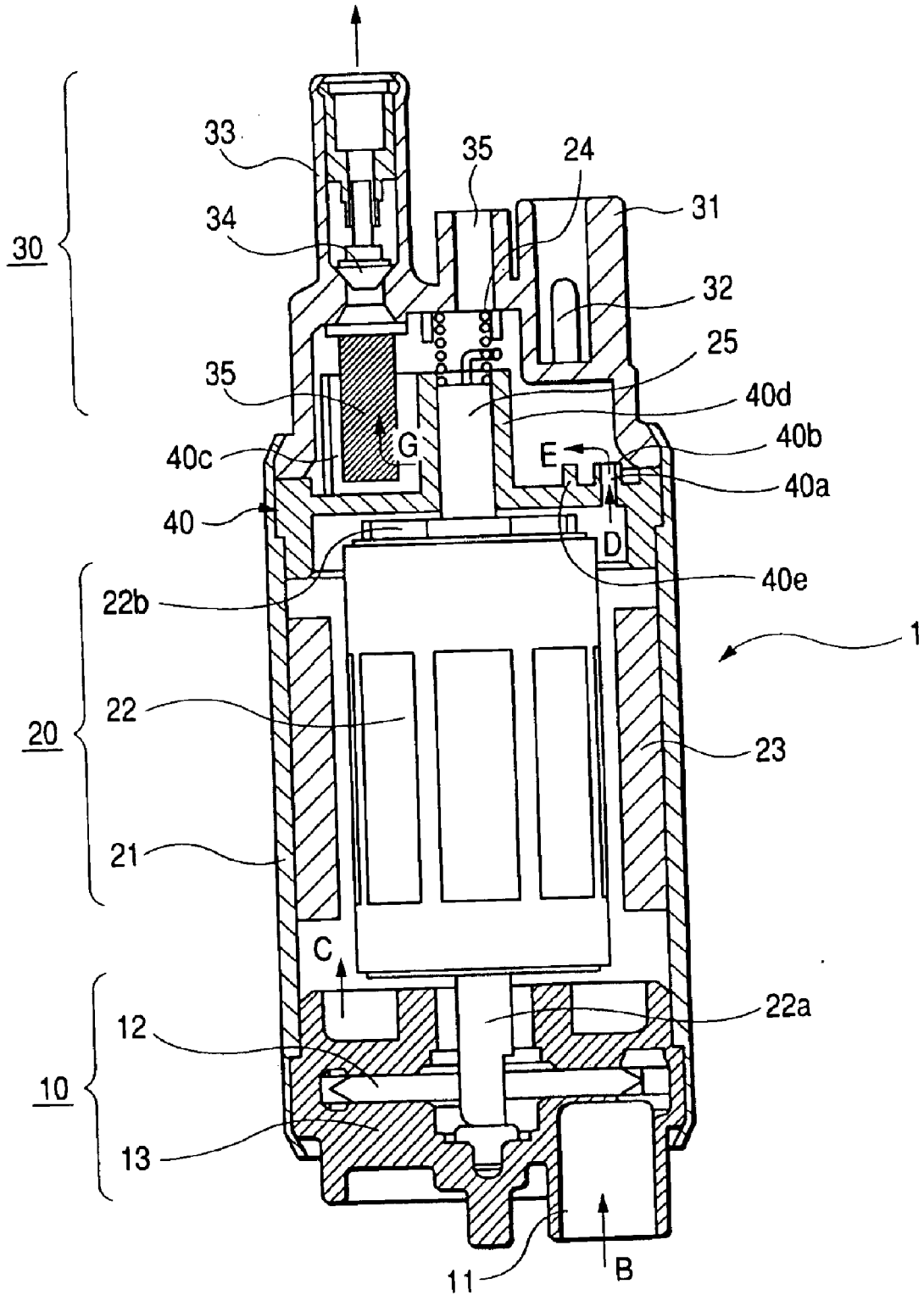
FIG. 2 is a longitudinal cross-sectional view of a fuel pump as shown in FIG. 1.
Figure 3:
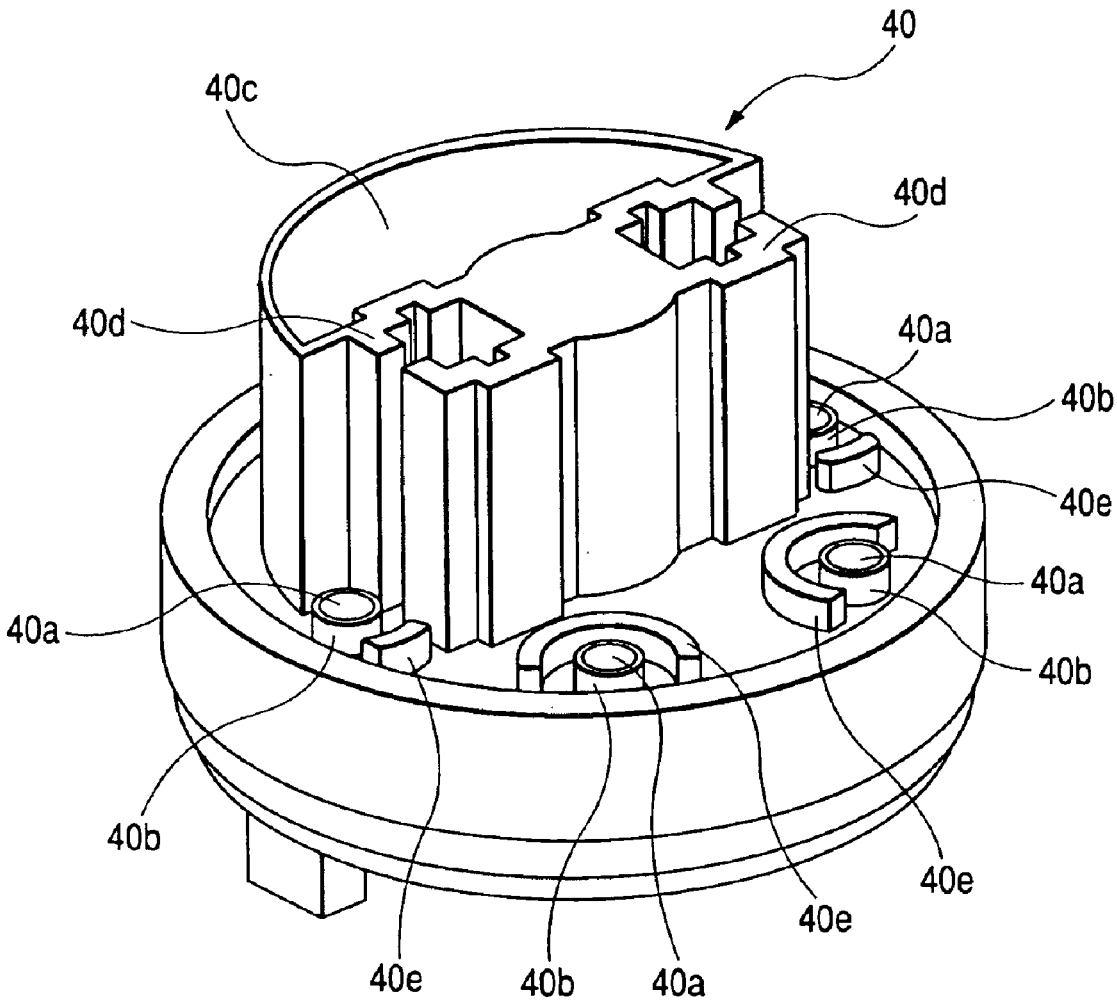
FIG. 3 is an enlarged perspective view of a spacer constituting the fuel pump as shown in FIG. 2.

FIG. 1 is a view showing a fuel supply system according to an embodiment 1 of the invention. FIG. 2 is a longitudinal cross-sectional view of a fuel pump as shown in FIG. 1. FIG. 3 is an enlarged perspective view of a spacer composing the fuel pump as shown in FIG. 2.

In these figures, the fuel supply system 100 comprises a fuel pump 1 for sucking and discharging a fuel 5 from a fuel tank 6, a bracket 2 having a discharge pipe 2*a* for discharging the fuel that is fed under pressure into an injector attached to an internal combustion engine for vehicle, not shown, a power supply connector 2*b* for supplying power from a battery mounted on the vehicle to the fuel pump 1, and a stay 2*c* for holding the fuel pump 1, a suction filter 3 having a filtering particle diameter of 10 to 30. m and formed of a nonwoven fabric, for example, the suction filter being mounted over a suction opening 11 of the fuel pump 1 to capture the debris such as dust contained in the fuel 5 within the fuel tank 6 and prevent it from entering the fuel pump 1, and a pressure regulator 4 for regulating the pressure of fuel discharged from the fuel pump 1 via the discharge pipe 2*a*, the pressure regulator being disposed on a cover out 31 forming the fuel pump 1 and mounted on a return nipple 35. The fuel supply system 100 is suspended from an opening portion 6*a* of the fuel tank 6.

The fuel pump 1 comprises a pump portion 10, a motor portion 20, a cover out portion 30, and a spacer 40. The pump portion 10 includes a suction port 11 on which the suction filter 3 is mounted, a body of rotation 12 for increasing the pressure of fuel sucked through the suction port 11 owing to a well-known pump action, and a pump casing 13 for accommodating the body of rotation 12.

The motor portion 20 includes a cylindrical yoke 21, a rotor 22 connected via a shaft 22*a* to the body of rotation 12, a magnet 23 disposed around the rotor 22, a commutator 22*b* disposed above the rotor 22 to supply electric power supplied from the electric connector 2*b* via a brush 25 to the windings of the rotor 22, not shown, and a brush spring 24 for pressing the brush 25 against the commutator 22*b*.

The brush 25 and the commutator 22*b* are made of carbon that little produces abrasion powder when sliding.

The cover out portion 30 includes the cover out 31 formed of polyacetal resin molding, for example, a power supply terminal 32 for relaying electric power supplied from the power supply connector 2*b* to the motor portion 20, a discharge nipple 33 for discharging the fuel, a check valve 34 for preventing a decrease in the pressure of fuel discharged from the discharge nipple 33 into the injector, the check valve being closed when power supply to the fuel pump 1 is stopped, a return nipple 35 for expelling the fuel within the cover out 31 to the pressure regulator 4, and a discharge filter 36 for filtering the fuel flowing from the fuel motor portion 2*c* and discharged from the discharge nipple 33, the discharge filter being fixed to the cover out 31.

When the discharge filter 36 is made of thermoplastic resin such as nylon mesh (net), the discharge filter 36 is fixed to the cover out 31 by thermal welding. On the other hand, when the discharge filter 36 is made of sintered material such as sintered metal containing stainless steel, porous carbon or ceramic, the discharge filter 36 is integrally formed with the cover out 31 by insert molding when the cover out 31 formed of thermoplastic resin molding is molded.

The spacer 40 is interposed between the motor portion 20 and the cover out portion 30, and has at least one fuel passage hole 40*a* at a circumferential position around the outer diameter of the rotor 22. The fuel within the motor portion 20 is flowed through the fuel passage hole 40*a* into the cover out portion 30.

A rib 40*b* is protruded on the side of the cover out portion 30 in the fuel passage hole 40*a*. Near the discharge filter 36, a semicircular debris storage case 40*c*, a brush guide 40*d* for slidably holding the brush 25, and a debris stopper 40*e* are formed integrally with the spacer 40.

The debris storage case 40*c* may be formed by another member from the spacer 40, but integrally formed more cheaply.

The operation of the fuel supply system according to the embodiment 1 of this invention will be described below.

When a power is supplied from the battery mounted on the vehicle, not shown, via the power supply connector 2*b*, the power supply terminal 32, the brush 25 and the commutator 22*b* to the rotor 22, the rotor 22 is rotated according to a known operation, so that the body of rotation 12 connected to the shaft 22*a* is rotated integrally.

If the body of rotation 12 is rotated, the fuel 5 within the fuel tank 6 is filtered through the suction filter 3 due to a known pump action (arrow A), flowing into the pump casing 13 (arrow B) to increase the pressure, and discharged into the motor portion 20 (arrow C).

Since the fuel filter 3 has a filtering particle diameter of 10 to 30. m, the debris having a particle diameter of 30. m or more contained in the fuel 5 is not sucked into the pump portion 10 to damage the body of rotation 12 and the pump casing 13, thereby preventing the lower pump performance.

The fuel within the motor portion 20 is passed through the fuel passage hole 40*a* of the spacer 40 (arrow D) and flowed into the cover out portion 30 (arrow E).

Since the fuel passage hole 40*a* is disposed at a circumferential position around the outer diameter of the rotor 22, the debris flowing into the cover out portion 30 is flowed back through the fuel passage hole 40*a* to the motor portion 20 without sticking to any sliding portion between the commutator 22*b* and the brush 25 located above the rotor 22, or any sliding portion of the shaft 22*a* of the rotor 22, when power supply to the fuel pump 1 is stopped. Thereafter, when the fuel pump 1 is restarted, the sliding portion is not damaged by the debris, thereby enhancing the reliability.

Since the spacer 40 is provided with the rib 40*b* on the side of the cover out portion 30 in the fuel passage hole 40*a*, and the debris stopper 40*e* near the fuel passage hole 40*a*, the debris is difficult to return to the motor portion 20 owing to the rib 40*b* and the debris stopper 40*e*, further enhancing the reliability.

Furthermore, the debris storage case 40*c* disposed near the discharge filter 36 stores the debris having a larger filtering particle diameter captured by the discharge filter 36, thereby reducing the amount of debris deposited on an upper surface of the spacer 40, further enhancing the reliability.

Then, the fuel flowing into the cover out portion 30 is regulated at a certain pressure by the pressure regulator 4 connected via the return nipple 35 to the cover out 31. The fuel containing the debris is returned into the tank 6 (arrow F in FIG. 1), but only the fuel required in the injector is flowed into the discharge filter 36 (arrow G). The debris such as abrasion powder of the brush 25 and the commutator 22*b* in the fuel is filtered, and discharged via the discharge nipple 33 through the discharge pipe 2*a* into the injector (arrow H).

Generally, in the internal combustion engine for vehicle, since a small amount of fuel is discharge into the injector, a small amount of fuel is passed through the discharge filter 36, and most of the fuel is passed through the pressure regulator 4 and returned into the fuel tank 6. Therefore, the filtering area of fuel can be smaller, whereby the size of the discharge filter 36 is reduced.

As described previously, the debris having a particle diameter of 30. m or more in the fuel sucked by the pump portion 10 is filtered through the suction filter 3, so that the debris captured by the discharge filter 36 only contains the abrasion powder having a particle diameter of 30. m or more among the abrasion powder of the commutator 22*b* and the brush 25. However, since a combination of the commutator 22*b* formed of carbon and the brush 25 has a small amount of abrasion in sliding, the filtering area of fuel can be smaller, whereby the size of the discharge filter 36 is reduced.

Figure 4:
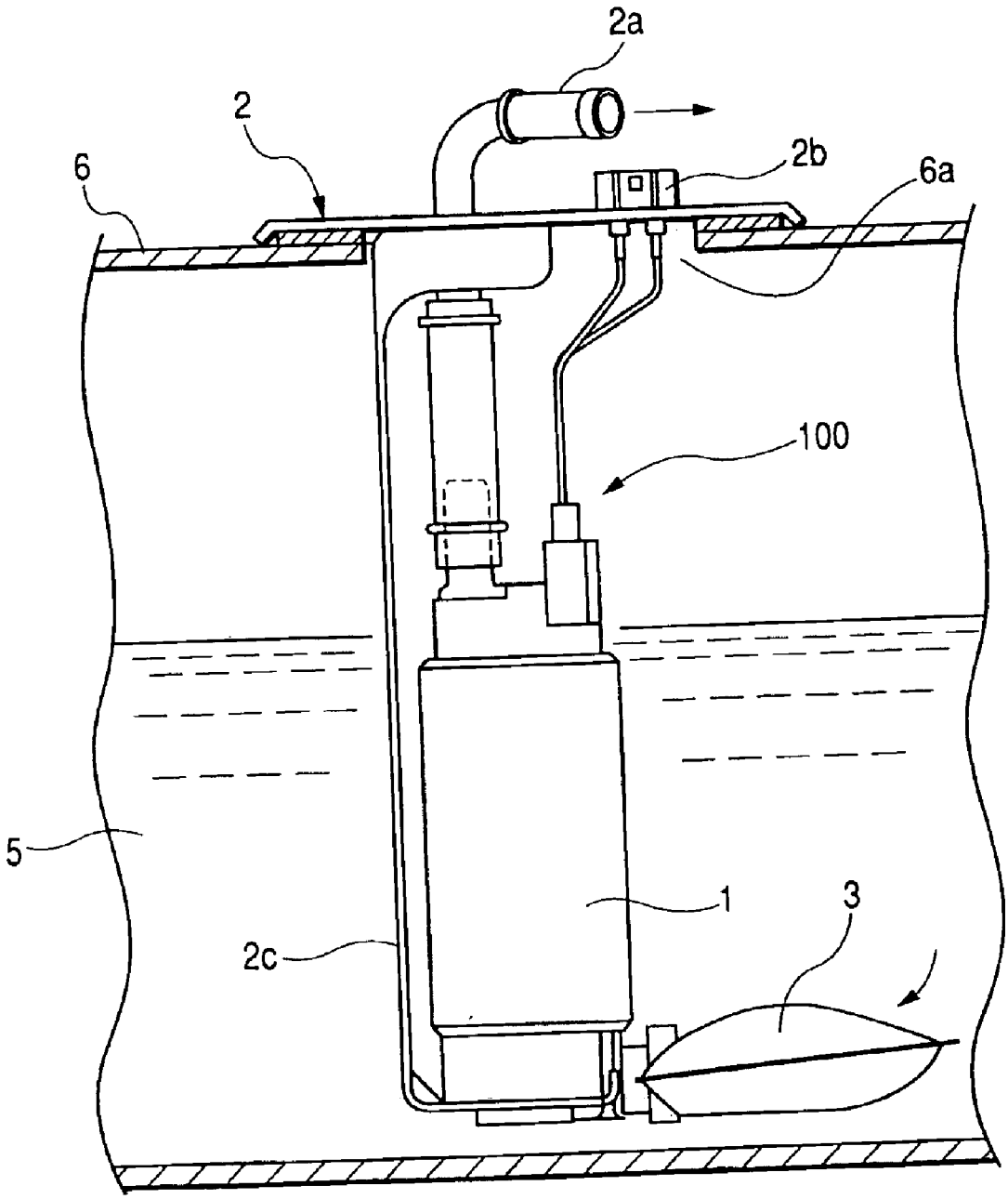
FIG. 4 is a view showing an example in which a pressure regulator is not connected to the fuel pump of FIG. 1.

In this embodiment, the fuel flowing into the cover out portion 30 is returned into the fuel tank 6, while the fuel pressure is being regulated by the pressure regulator 4 connected via the return nipple 35 to the cover out portion 31. However, the pressure regulator 4 is not provided within the fuel tank 2 (as indicated in FIG. 4), but may be provided on the downstream side of the discharge pipe 2*a* to return the fuel into the fuel tank 6.

(Embodiment 2)

Figure 5:
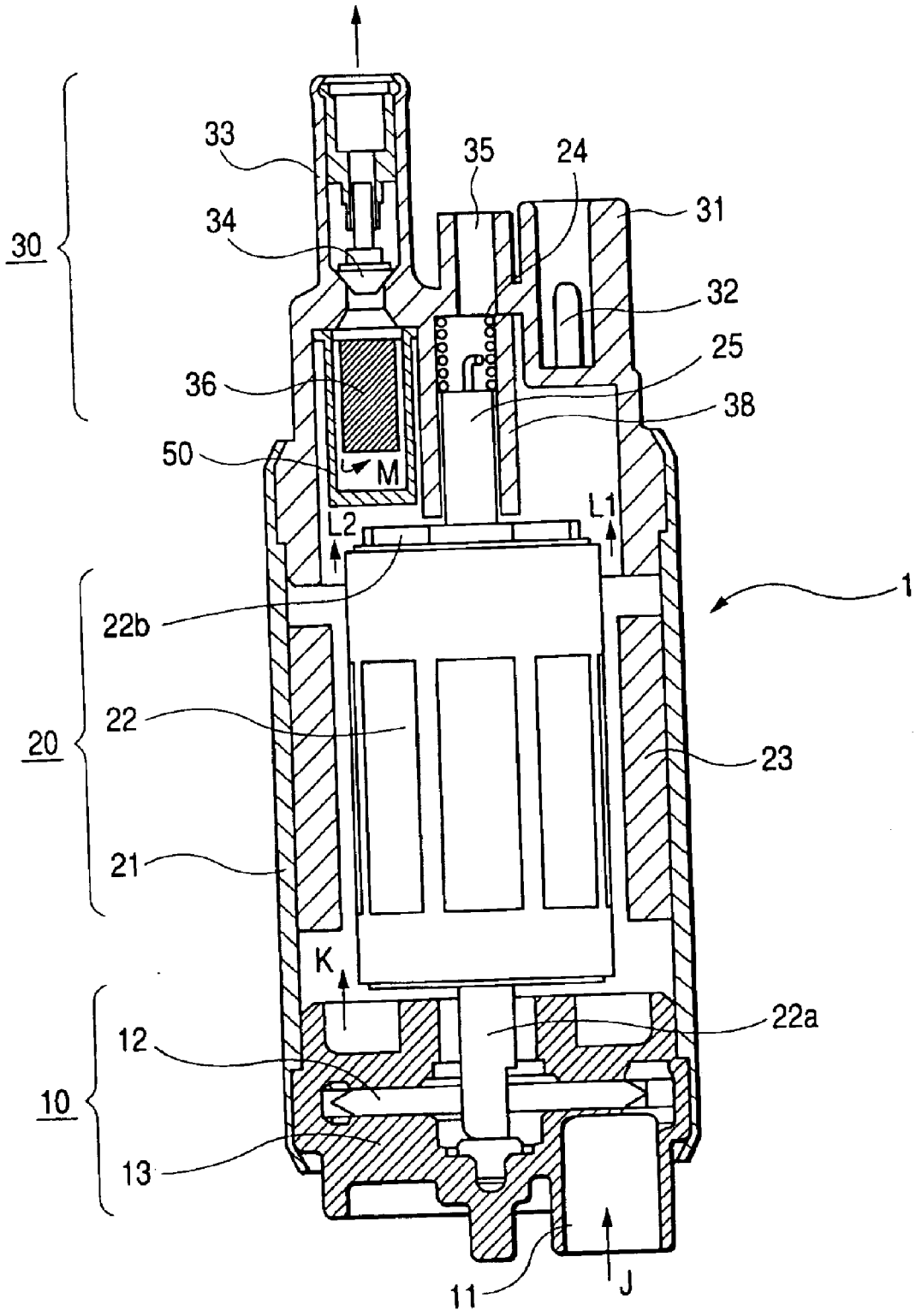
FIG. 5 is a longitudinal dross-sectional view of a fuel pump accord ing to an embodiment 2 of the invention.

FIG. 5 is a longitudinal cross-sectional view of a fuel pump according to an embodiment 2 of the invention.

In FIG. 5, a debris storage case 50 is disposed near the discharge filter 36, and fixed to the cover out 31 by welding, for example. The brush 25 is slidably carried by the brush guide 38 formed integrally with the cover out 31.

The other constitution of the pump portion 10, the motor portion 20 and the cover out portion 30 is the same as in the embodiment 1.

The operation of the fuel supply system according to the embodiment 2 of this invention will be described below.

When a power is supplied from the battery mounted on the vehicle, not shown, via the power supply connector 2*b*, the power supply terminal 32, the brush 25 and the commutator 22*b* to the rotor 22, the rotor 22 is rotated according to a known operation, so that the body of rotation 12 connected to the shaft 22*a* is integrally rotated.

If the body of rotation 12 is rotated, the fuel 5 within the fuel tank 6 is filtered through the suction filter 3 due to a known pump action, flowing into the pump casing 13 (arrow J) to increase the pressure, and discharged into the motor portion 20 (arrow K).

The fuel within the motor portion 20 passes along the arrow L1, L2 to flow into the discharge filter 36 (arrow M) to remove the debris in the fuel, containing, for example, abrasion powder of the brush 25 and the commutator 22*b*. Then, the fuel is discharged via the discharge nipple 33 and the discharge pipe 2*a* into the injector.

In the fuel supply system according to the embodiment 2 of the invention, the debris storage case 50 for storing the debris in the fuel captured by the discharge filter 36 is provided near the discharge filter 36. Thus, the debris having a larger filtering particle diameter captured by the discharge filter 36 among the debris produced in the motor portion 20 is stored within the debris storage case 50. As a result, there is no debris depositing within the motor portion 20 or sticking to the motor driving portion. The fuel supply system has a high reliability.

What is claimed is:

1. A fuel supply system comprising:

a bracket fitted around an opening portion of a fuel tank and having a discharge pipe disposed; and a fuel pump for sucking a fuel from said fuel tank and discharging the fuel through said discharge pipe, said fuel pump being mounted on said bracket, wherein said fuel pump comprises:

a pump portion for sucking and discharging the fuel from said fuel tank;

a motor portion for rotating a rotor accommodated within said pump portion, through which the fuel discharged from said pump portion is passed internally;

a cover out portion for accommodating a discharge filter for filtering the fuel passed through said motor portion; and a debris storage case for storing the debris in the fuel that is captured by said discharge filter, said case being disposed near said discharge filter.

2. A fuel supply system comprising:

a bracket fitted around an opening portion of a fuel tank and having a discharge pipe disposed; and a fuel pump for sucking a fuel from said fuel tank and discharging the fuel through said discharge pipe, said fuel pump being mounted on said bracket, wherein said fuel pump comprises:

a pump portion for sucking and discharging the fuel from said fuel tank;

a motor portion for rotating a rotor accommodated within said pump portion, through which the fuel discharged from said pump portion is passed internally;

a cover out portion for accommodating a discharge filter for filtering the fuel passed through said motor portion; and a spacer inserted between said motor portion and said cover out portion; and wherein a fuel passage hole for passing the fuel flowing from within said motor portion into said cover out portion is disposed at a circumferential position of said spacer around an outer diameter of said rotor in said motor portion.

3. The fuel supply system according to claim 2, wherein a rib is protruded on the side of said cover out portion in said fuel passage hole.

4. The fuel supply system according to claim 2, wherein a debris stopper is provided near said fuel passage hole.

5. The fuel supply system according to claim 2, wherein a debris storage case for storing the debris captured by said discharge filter is provided near said discharge filter.

6. The fuel supply system according to claim 5, wherein said debris storage case is formed integrally with said spacer.

7. The fuel supply system according to claim 1, further comprising a suction filter for filtering the fuel sucked into said pump portion, in which a brush and a commutator for the motor portion are made of carbon, and the filtering particle diameter for said discharge filter and said suction filter is from 10 to 30. m.

8. The fuel supply system according to claim 1, further comprising a pressure regulator for returning the fuel within said cover out portion to the fuel tank, when the fuel pressure within said cover out portion reaches a predetermined pressure.

* * * * *